United States Patent [19]

Baker et al.

[11] 4,392,575

[45] Jul. 12, 1983

[54] SWIVEL ASSEMBLY FOR END COCK

[75] Inventors: Thomas B. Baker; Richard J. Mandrell, both of St. Charles, Mo.

[73] Assignee: ACF Industries, Incorporated, New York, N.Y.

[21] Appl. No.: 259,626

[22] Filed: May 1, 1981

[51] Int. Cl.[3] ..... B61G 5/08; F16L 3/16

[52] U.S. Cl. ..... 213/76; 285/63; 137/347

[58] Field of Search ..... 285/62, 63, 168, 122, 285/272; 213/76, 1 R; 137/348, 349, 615, 350, 347; 251/137; 246/172; 105/1 A, 1 R, 251

[56] References Cited

U.S. PATENT DOCUMENTS

| | | | |
|---|---|---|---|
| 424,780 | 4/1890 | Gold | 285/63 |
| 602,821 | 4/1898 | Benson | 285/63 |
| 947,280 | 1/1910 | Gold | 285/63 |
| 960,889 | 6/1910 | Garrett | 285/63 |
| 1,031,642 | 7/1912 | Haase | 285/272 |
| 1,310,391 | 7/1919 | Dodge | 285/168 |
| 2,411,735 | 11/1946 | King | 137/347 |

*Primary Examiner*—Bruce H. Stoner, Jr.
*Assistant Examiner*—Richard Mathieu
*Attorney, Agent, or Firm*—Henry W. Cummings

[57] ABSTRACT

In accordance with the present invention, a swivel fitting is used to connect the glad hand to the rigid portion of the brake system on the car. The swivel fitting includes a freely rotatable swivel extension which extends through an opening in a support structure. A rigid curved pipe section is connected to the swivel extension with a 45° elbow. The rigid pipe section and 45° elbow may swivel about a horizontal axis. The curved pipe extends upwardly and inboard of the car where it joins brake piping extending inboard of the car. A conventional end cock is attached to the swivel fitting with appropriate fasteners. A 45° elbow is used to removably connect the glad hand of the train line to the end cock.

5 Claims, 5 Drawing Figures

SWIVEL ASSEMBLY FOR END COCK

BACKGROUND OF THE INVENTION

For certain applications there are geometrical restrictions on certain portions of the train line to meet specific railway design criteria. For example in gondola cars which are unloaded by rotating the car 180° to a bottom side up position, the rigid portion of the train line is prohibited by an AAR regulation from extending longitudinally beyond the coupler housing striker plate. While the flexible portion of the train line extending between cars is disconnected during rotary dumping, if the rigid portion of the train line were to extend beyond the striker plate, it would interfere with the rotary dumping operation.

Furthermore, because of clearance restrictions caused by end diagonals and the hand brake support there is insufficient space to weld the rigid portion of the train line to the end sill. Thus the rigid portion must be located elsewhere.

Another problem is that a connection must be provided on the inboard side of the rigid portion to allow connection of a bent pipe portion which makes a turn of nearly 180°.

The inboard connection also must avoid abutting a wheel when the wheel is in an inwardly rotated position.

SUMMARY OF THE INVENTION

The object of the invention is to provide a connection assembly to removably attach the glad hand of the train line to the end cock adjacent the outer end sill and the outer face of the coupler striker plate, and thus comply with AAR clearance restrictions concerning the rigid portion of the train line relative to the outer face of the striker plate, and at the same time avoid a wheel abutting the connection when the wheel is rotated inwardly.

In accordance with the present invention, a swivel fitting is used to connect the glad hand and flexible portions of the train line to the rigid portions. The swivel fitting includes a freely rotatable swivel extension which extends through a support surface. A rigid curved pipe section is connected to the swivel extension with a 45° elbow. The curved pipe swivels about a horizontal axis. The curved pipe preferably extends upwardly and inboard of the car where it joins right brake piping extending inboard of the car. The rigid portion includes a conventional end cock attached to the swivel fitting with appropriate fasteners. A 45° elbow is used to removably connect the glad hand of the train line to the end cock.

THE DRAWINGS

DESCRIPTION OF PREFERRED EMBODIMENTS

Figure 3:
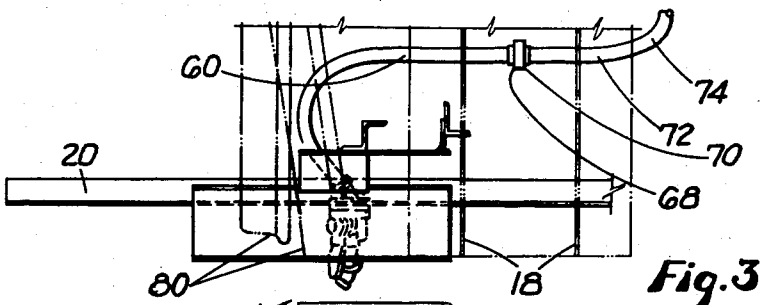
FIG. 3 is a plan view of the brake arrangement of the present invention.

An open top railway hopper car is indicated in the drawings generally at 10. This hopper car includes an end wall 12 and a pair of diagonal braces 14 and 16 (FIG. 2), which extend downwardly from the end wall and engage a center sill 18 according to known construction. An end sill 20 is welded to the center sill 18. A hand brake step 22 is generally welded to the end sill including depending supports 24, which are welded to the end sill.

Figure 4:
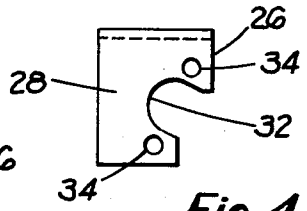
FIG. 4 is a detailed view of the angle plate utilized in the present invention.
Figure 5:
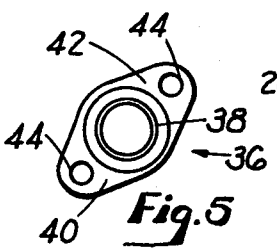
FIG. 5 is a detailed view of the swivel fitting used in the present invention.

In accordance with the present invention, an angle bracket 26 is welded to the end sill 20. The bracket 26 includes a depending portion 28 having a formed contour slot 32 and fastener openings 34 (FIG. 4). A swivel 36 is adopted to abut the bracket 28. The swivel 36 includes a freely rotatable projecting portion 38 which projects inwardly beyond bracket portion 28 and flange portions 42 and 40 (FIG. 5) having fastener openings therein 44.

The projecting portion 38 is internally threaded and is adopted to receive an externally threaded 45° elbow 45. An end cock 48 abuts swivel 36 and includes a flange portion 50 having fastener openings therein, an externally threaded front portion 52 and an operating handle 54. End cock 48 is a commercially available end cock, Westinghouse Air Brake Division (WABCO), American Standard Inc., Wilmerding, Pennsylvania 15148, Part No. 581,829. Another 45° elbow 56 is externally threaded and is threaded into front portion 52. Elbows 45 and 52 are commercially available items, Westinghouse Air Brake Co., Part No. 573,686. Elbow 56 is internally threaded to receive a conventional glad hand hose 57. Fasteners 58 having threaded nuts 59 maintain the assembly of swivel 36 and end cock 48 in abutting relationship supported by angle bracket 26.

It is to be noted that the assembly of the end cock 48, the end cock handle 54 and the 45° fitting 56 are all located within the AAR clearance line C-L for rotary dump cars. This clearance line is fixed by the AAR and is published in AAR Rotary Dump Train Positioner Standard, S-253-79, adopted 1978, page C-207, and illustrated in FIG. 1 at C-L.

A curved pipe 60 bent to a radius of 9" is threaded into the elbow 45. The elbow 45 may swivel about a horizontal axis. This swiveling action reduces loads applied to the assembly by virtue of the curved pipe 60. This curved pipe extends inwardly inboard of the car and upwardly, then laterally across the car behind hand brake support 62 and through openings 64 provided in diagonal brace 14. (See FIGS. 1, 3 and 4). A doubler plate 66 is provided to reinforce the openings 64. Pipe 60 terminates in split flange sockets 68 and 70. One socket is provided with a gasket WABCO, Part No. A579,687, and one is provided in a groove 70 in a known manner. Another pipe 72 section contains a bend 74 and extends vertically downwardly and inwardly to the rest of the brake system.

Figure 1:
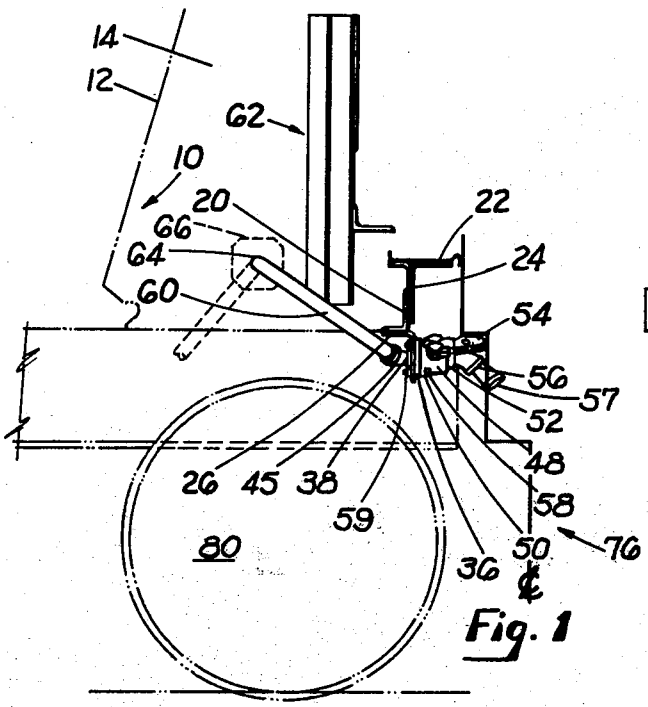
FIG. 1 is a vertical side elevation view of the brake arrangement of the present invention.

It is apparent from FIG. 1 that the assembly of the elbow 45, the swivel 36 and the end cock 48 are located within the AAR clearance line C-L.

Furthermore, the car is supported by a conventional truck 76 including wheels 80. The wheels 80 do not abut the elbow 46 in the most inwardly rotated position. Thus this connection assembly is believed to be a unique and unobvious mechanical arrangement.

Figure 2:
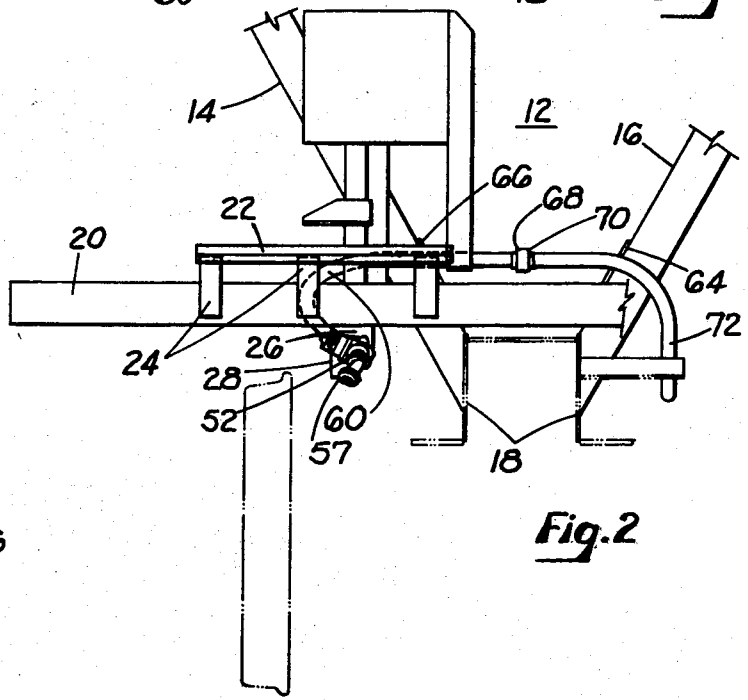
FIG. 2 is a front elevation view of the brake arrangement of the present invention.

Location of the glad hand connection 57 on the left hand side as viewed in FIG. 2, rather than on the right as is normally the case, is necessary for a double rotary coupler car. Such double rotary coupler cars are often located adjacent the engine and adjacent the caboose in a train of coal cars.

What is claimed is:

1. A trainline connection assembly comprising: a support plate adapted to be rigidly attached to an end portion of the car; said plate including a slot; a swivel having a swivel flange portion engaging said plate and a swivel extension portion extending through said slot; said extension being freely rotatable about said swivel flange portion; said swivel having a hollow center portion; said swivel extension portion extending generally horizontally and having means including an extension elbow having an angle of less than 90° to receive a rigid pipe section extending inboard of the car; an end cock located outboard of said swivel and having an end cock flange portion abutting said swivel flange portion; means holding said swivel and said end cock in assembly and supported by said support plate; said end cock including a handle extending outboard of said end cock; said end cock including glad hand connecting means including a glad hand elbow of less than 90° for receiving a flexible portion of the train line; said handle and said glad hand connecting means located within AAR clearance requirements for railway cars.

2. A train line connecting assembly according to claim 1, wherein said glad hand elbow is a 45° elbow.

3. A train line connecting assembly according to claim 1, wherein said extension elbow is a 45° elbow.

4. A train line connecting assembly according to claim 3, wherein said rigid pipe extends vertically and makes an angle of about 180° with the horizontal.

5. A train line connecting assembly according to claim 4, wherein said rigid pipe passes through a pair of end diagonals of the car.

* * * * *